US007225708B2

(12) United States Patent
Chen

(10) Patent No.: US 7,225,708 B2
(45) Date of Patent: Jun. 5, 2007

(54) RATCHET TOOL HAVING SMOOTH ENGAGING MEMBER

(76) Inventor: Hsin-Nien Chen, No. 10, Lane 143, Sec. 1, Hsin Shen South Road, Taipei 10653 (TW)

( * ) Notice: Subject to any disclaimer, the term of this patent is extended or adjusted under 35 U.S.C. 154(b) by 0 days.

(21) Appl. No.: 11/215,160

(22) Filed: Aug. 30, 2005

(65) Prior Publication Data

US 2007/0044594 A1 Mar. 1, 2007

(51) Int. Cl.
*B25B 13/46* (2006.01)

(52) U.S. Cl. ..... 81/63.1; 81/60; 192/43.2

(58) Field of Classification Search ..... 81/60–63.2; 192/43.1, 43.2

See application file for complete search history.

(56) References Cited

U.S. PATENT DOCUMENTS 5,573,093 A * 11/1996 Lee ..... 81/63.1
5,582,081 A 12/1996 Lin
6,047,802 A * 4/2000 Huang ..... 81/63.1
6,227,077 B1 5/2001 Chiang
6,250,183 B1 6/2001 Chiang
6,450,312 B1 * 9/2002 Hsiao ..... 81/63.1
6,523,439 B1 * 2/2003 Huang ..... 81/63.1
7,028,587 B1 * 4/2006 Chiang ..... 81/63.1

* cited by examiner

*Primary Examiner*—Hadi Shakeri
(74) *Attorney, Agent, or Firm*—Charles E. Baxley

(57) ABSTRACT

A ratchet tool includes a tool member rotatably engaged into a cartridge and having a gear, two pawls slidably received in the cartridge and each having one or more teeth biased to engage with the gear of the tool member, and a control ferrule may control the engagement of the pawls with the gear of the tool member, and the pawls each include a ball, a roller, or a rounded or rotary or smooth member engaged between the control ferrule and the pawls, for forming a reduced contact area between the control ferrule and the smooth member, and for allowing the pawls to be effectively moved relative to the cartridge, and to be disengaged from or to be engaged with the gear of the tool member by the control ferrule.

8 Claims, 4 Drawing Sheets

RATCHET TOOL HAVING SMOOTH ENGAGING MEMBER

BACKGROUND OF THE INVENTION

1. Field of the Invention

The present invention relates to a ratchet tool, and more particularly to a ratchet tool having a rounded or smooth pawl engaging mechanism for allowing pawls to be smoothly actuated to engage with a gear by a control ferrule.

2. Description of the Prior Art

Various kinds of typical ratchet tools or ratchet mechanisms have been developed and each comprises a block or cartridge attached to a handle, a rod or gear rotatably engaged into the block or cartridge for coupling to a driving shank, and two pawls slidably engaged into the block or cartridge for being biased to engage with the rod or gear, in order to control the driving direction of the driving shank.

For example, U.S. Pat. No. 5,523,093 to Lee, and U.S. Pat. No. 5,522,081 to Lin disclose two of the typical ratchet tools or ratchet mechanisms each also comprising a driving shank for coupling to a base cartridge of the handle selectively with two pawls, and the pawls each includes a number of teeth for engaging with the teeth of the rod or gear or driving shank, in order to determine or to control the driving direction of the driving shank relative to the handle.

Normally, a control ferrule is rotatably attached onto the handle or the base cartridge, and engaged with the pawls, for selectively urging or forcing the pawls to engage with the teeth of the rod or gear or driving shank respectively.

However, the control ferrule is frictionally engaged with the pawls and a frictional force may be occurred or generated between the pawls and the control ferrule, such that the pawls may not be easily and smoothly forced and moved to engage with the teeth of the rod or gear or driving shank by the control ferrule, and such that rubbing or wearing problems may be occurred or generated between the pawls and the control ferrule.

U.S. Pat. No. 6,227,077 to Chiang, and U.S. Pat. No. 6,250,183 to Chiang disclose two further typical ratchet tools or ratchet mechanisms each also comprising a driving shank coupling to a base cartridge of the handle selectively with two pawls, and the pawls each includes a number of teeth for engaging with the teeth of the rod or gear or driving shank, in order to control the driving direction of the driving shank relative to the handle.

Similarly, a control ferrule is also required to be rotatably attached or engaged onto the handle or the base cartridge, and engaged with the pawls, for selectively urging or forcing the pawls to engage with the teeth of the rod or gear or driving shank respectively.

However, similarly, the control ferrule is also frictionally engaged with the pawls, such that the pawls may not be easily and smoothly forced and moved to engage with the teeth of the rod or gear or driving shank by the control ferrule, and such that rubbing or wearing problems may be occurred or generated between the pawls and the control ferrule.

The present invention has arisen to mitigate and/or obviate the afore-described disadvantages of the conventional ratchet tools.

SUMMARY OF THE INVENTION

The primary objective of the present invention is to provide a ratchet tool including a rounded or smooth pawl engaging mechanism for allowing the pawls to be smoothly actuated to engage with the gear or the driving shank by the control ferrule, without forming or generating a frictional force or without generating rubbing or wearing problems between the pawls and the control ferrule.

In accordance with one aspect of the invention, there is provided a ratchet tool comprising a cartridge for attaching to a tool handle and including a chamber formed therein, and including two channels formed therein and communicating with the chamber thereof, a tool member rotatably engaged into the chamber of the cartridge, and including a gear provided thereon, two pawls slidably received in the channels of the cartridge respectively, and each including at least one tooth formed therein, a spring biasing device for biasing the tooth of the pawls to selectively engage with the gear of the tool member, and a control ferrule rotatably attached onto the cartridge, for engaging with the pawls, and for controlling an engagement of the pawls with the gear of the tool member. The pawls each includes a smooth member provided thereon and engaged between the control ferrule and the pawls, for forming a reduced contact area between the control ferrule and the smooth member, and for allowing the pawls to be effectively moved relative to the cartridge and the tool member and to be disengaged from or to be engaged with the gear of the tool member by the control ferrule, and thus for allowing the pawls to be smoothly actuated to engage with the gear of the tool member by the control ferrule, without forming or generating a frictional force or without generating rubbing or wearing problems between the pawls and the control ferrule, to allow the working life of the pawls and the control ferrule to be increased.

The pawls each includes a recess formed therein for receiving the smooth member therein, and arranged for engaging the smooth member between the control ferrule and the pawls. The smooth member may either be a ball, a roller, or other rounded or smooth or rotary members, for engaging with the control ferrule and, thus for reducing the contact area between the control ferrule and the pawls via the smooth member.

The control ferrule includes an inner peripheral surface and two actuating surfaces formed therein, for engaging with the pawls respectively, and includes three depressions formed therein, and the cartridge includes a spring-biased projection engaged therein, for engaging with either of the depressions of the control ferrule, and for positioning the control ferrule to the cartridge at selected angular positions, and thus for selectively maintaining the pawls in either disengagement from or in engagement with the control ferrule.

The control ferrule includes a slot formed therein, and the cartridge includes a protrusion extended therefrom, for engaging with the slot of the control ferrule, and for guiding and for limiting the control ferrule to rotate relative to the cartridge, and/or for controlling the pawls in engagement with the control ferrule.

The tool member includes an annular groove formed therein, and a positioning pin engaged into the cartridge, and engaged into the annular groove of the tool member, for rotatably anchoring and securing the tool member to the cartridge, and thus for preventing the tool member from being disengaged from the cartridge. The tool member includes a retaining ring attached thereto and engaged with the control ferrule, for rotatably securing the control ferrule to the tool member and to the cartridge.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
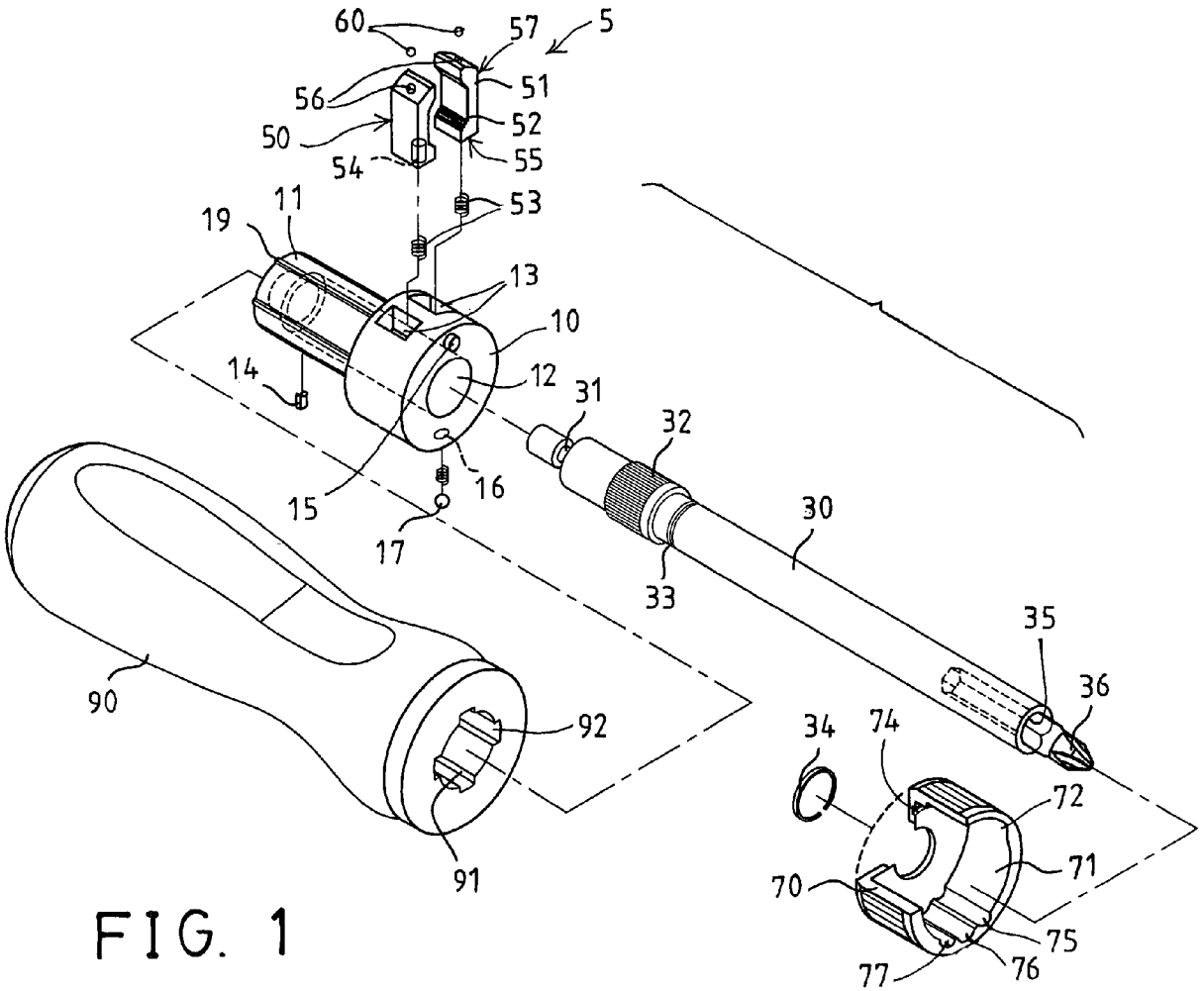
FIG. 1 is an exploded view of a ratchet tool in accordance with the present invention.
Figure 2:
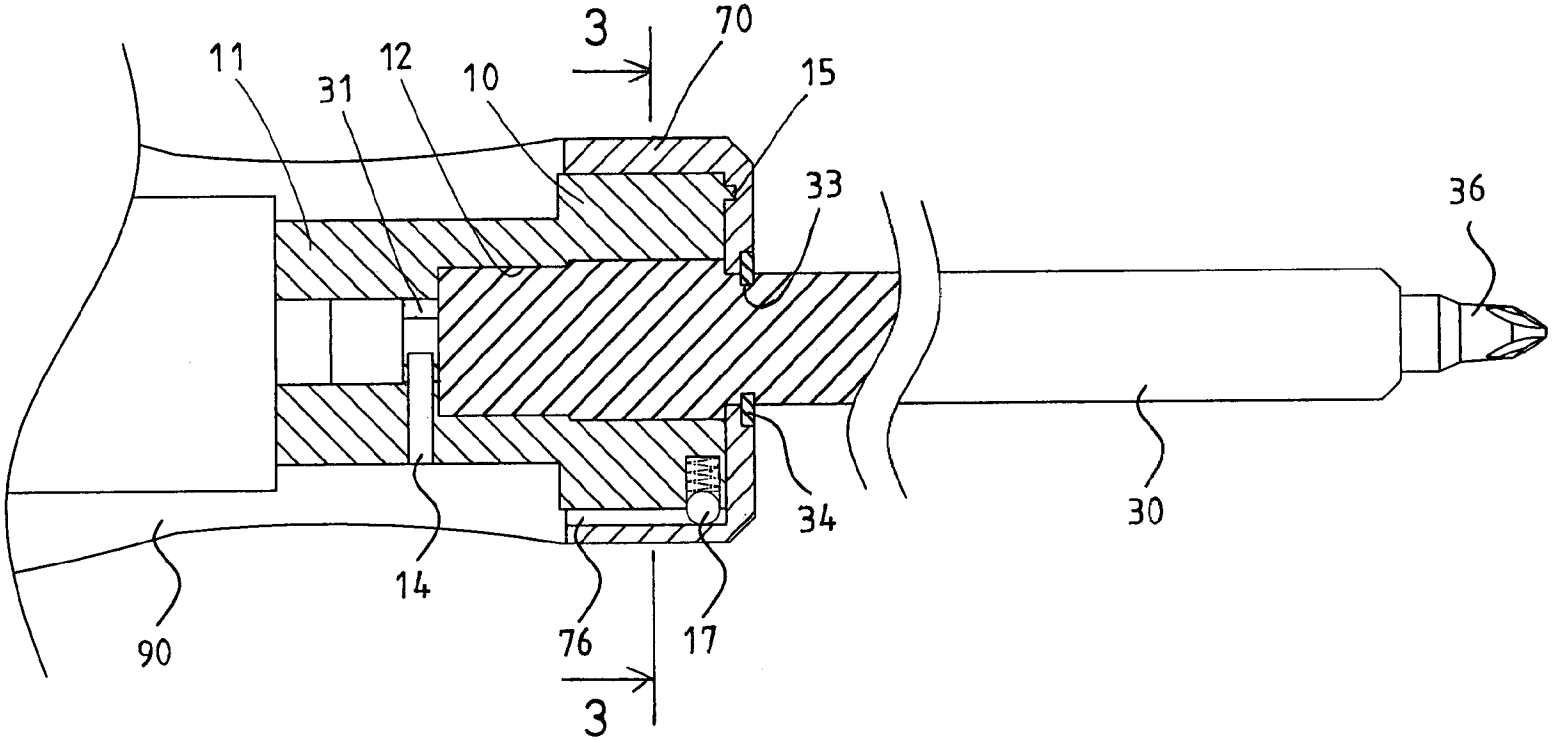
FIG. 2 is a partial cross sectional view of the ratchet tool, taken along lines 2—2 of FIG. 3.
Figure 3:
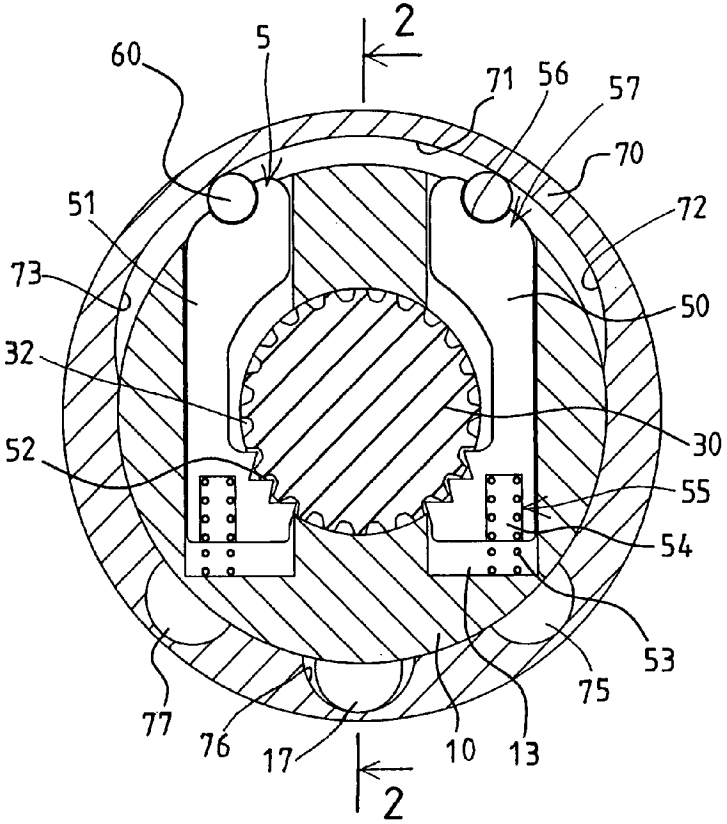
FIG. 3 is a partial cross sectional view of the ratchet tool, taken along lines 3—3 of FIG. 2.

Referring to the drawings, and initially to FIGS. 1–3, a ratchet tool in accordance with the present invention comprises a block or a cartridge 10 including an extension 11 extended therefrom, for coupling or attaching to a tool handle 90 (FIGS. 1, 2). For example, the tool handle 90 includes a non-circular socket opening 91 formed therein, and the extension 11 of the block or cartridge 10 also includes a corresponding non-circular cross section, for allowing the extension 11 of the block or cartridge 10 to be solidly attached to the tool handle 90, and to be prevented from being rotated relative to the tool handle 90.

Alternatively, the tool handle 90 may include one or more longitudinal channels 92 formed therein, and communicating with the socket opening 91 thereof, and the extension 11 of the block or cartridge 10 includes one or more longitudinal ribs 19 extended therefrom, for engaging into the corresponding channels 92 of the tool handle 90, and for preventing the block or cartridge 10 from being rotated relative to the tool handle 90. The cartridge 10 further includes a chamber 12 formed therein for rotatably receiving a tool member 30 therein, and includes two channels 13 formed therein and intersecting or communicating with the chamber 12 thereof, each for slidably receiving a pawl 50, 51 of a ratchet mechanism or device 5 therein.

For example, the tool member 30 may be a driving tool extension or driving shank 30, similar to the driving shaft as disclosed in U.S. Pat. No. 5,523,093 to Lee, and U.S. Pat. No. 5,522,081 to Lin, and U.S. Pat. No. 6,227,077 to Chiang, or may be a sleeve or barrel or the like as disclosed in U.S. Pat. No. 6,250,183 to Chiang, which may be taken as references for the present invention. The tool member 30 includes an annular groove 31 formed therein, and a positioning pin 14 is engaged into the cartridge 10 (FIGS. 1, 2), and engaged into the annular groove 31 of the tool member 30 (FIG. 2), for rotatably anchoring or securing or coupling the tool member 30 to the cartridge 10, and for preventing the tool member 30 from being moved axially and disengaged from the cartridge 10.

The tool member 30 includes a gear 32 formed or provided thereon, and includes another annular groove 33 formed therein, such as formed in the middle or intermediate portion thereof, for receiving or engaging with a clamping or retaining ring 34, and includes an engaging hole 35 formed therein, such as formed in the other end thereof, opposite to the annular grooves 31, 33 and the gear 32 thereof, for receiving or attaching a driving element 36, such as screw driving bits 36 thereto (FIGS. 1–2), and arranged for allowing the driving element 36 to be selectively rotated or driven by the cartridge. 10 and the tool handle 90 via the tool member 30 and the ratchet mechanism or device 5.

The ratchet device 5 includes two pawls 50, 51 each having one or more teeth 52 formed or provided thereon for engaging with the corresponding teeth of the gear 32, and a spring member 53 engaged with each of the pawls 50, 51, for biasing the teeth 52 of the pawls 50, 51 to engage with the corresponding teeth of the gear 32 of the tool member 30, and for determining or for controlling the driving direction of the tool member 30 and the tool element 36 relative to the cartridge 10 and the handle 90 or by the cartridge 10 and the handle 90. For example, the pawls 50, 51 each includes an orifice 54 formed in one end 55 thereof, for receiving the spring members 53 respectively, and for stably positioning or anchoring the spring members 53 to the pawls 50, 51 respectively.

Figure 4:
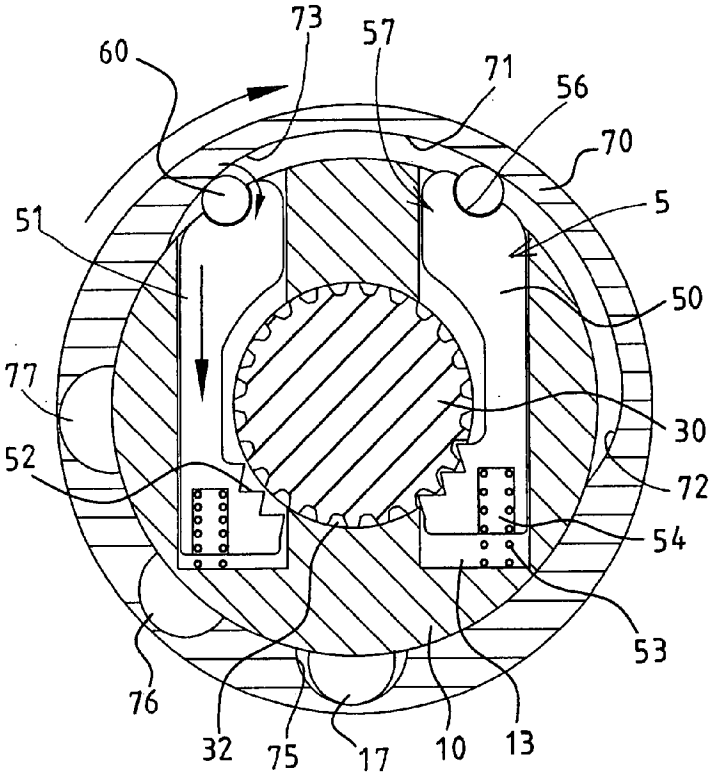
FIG. 4 is a partial cross sectional view similar to FIG. 3, illustrating the operation of the ratchet tool.

A control ferrule 70 is rotatably attached or engaged onto the cartridge 10 and/or the handle 90 and/or the tool member 30, and includes an inner peripheral surface 71 and two actuating surfaces 72, 73 formed therein, for engaging with the pawls 50, 51 respectively, and for selectively controlling or forcing or disengaging the teeth 52 of the pawls 50, 51 from the corresponding teeth of the gear 32 (FIG. 4). The engagement of the control ferrule 70 with the pawls 50, 51 is typical and will not be described in further details, and has been disclosed in the cited arts, which may also be taken as references for the present invention. The clamping or retaining ring 34 of the tool member 30 may be engaged with the control ferrule 70, for rotatably securing the control ferrule 70 to the tool member 30 and to the cartridge 10.

The cartridge 10 includes a protrusion 15 extended therefrom (FIGS. 1, 5), and includes a cavity 16 formed therein, and the control ferrule 70 includes a curved slot 74 formed therein for slidably receiving the protrusion 15 of the cartridge 10, for guiding the control ferrule 70 to rotate relative to the cartridge 10, and thus for limiting the control ferrule 70 to rotate relative to the cartridge 10. For example, the actuating surfaces 72, 73 of the control ferrule 70 may be controlled to be engaged with the pawls 50, 51 respectively when the protrusion 15 of the cartridge 10 is engaged in the ends of the curved slot 74 of the control ferrule 70. A spring-biased projection 17 is engaged in the cavity 16 of the cartridge 10, for positioning the control ferrule 70 to the cartridge 10 at selected positions, and for maintaining the engagement of the actuating surfaces 72, 73 of the control ferrule 70 with the pawls 50, 51 respectively.

For example, the control ferrule 70 includes three depressions 75, 76, 77 formed therein, for selectively receiving or engaging with the spring-biased projection 17, and thus for positioning the control ferrule 70 to the cartridge 10 at selected positions. For example, the actuating surfaces 72, 73 of the control ferrule 70 may be maintained in disengagement from the pawls 50, 51 respectively when the spring-biased projection 17 is engaged with the middle or intermediate depression 76 of the control ferrule 70 (FIG. 3), and may be maintained in engagement with either of the pawls 50, 51 when the spring-biased projection 17 is engaged with the respective side depression 75, 77 of the control ferrule 70 (FIG. 4).

Figure 5:
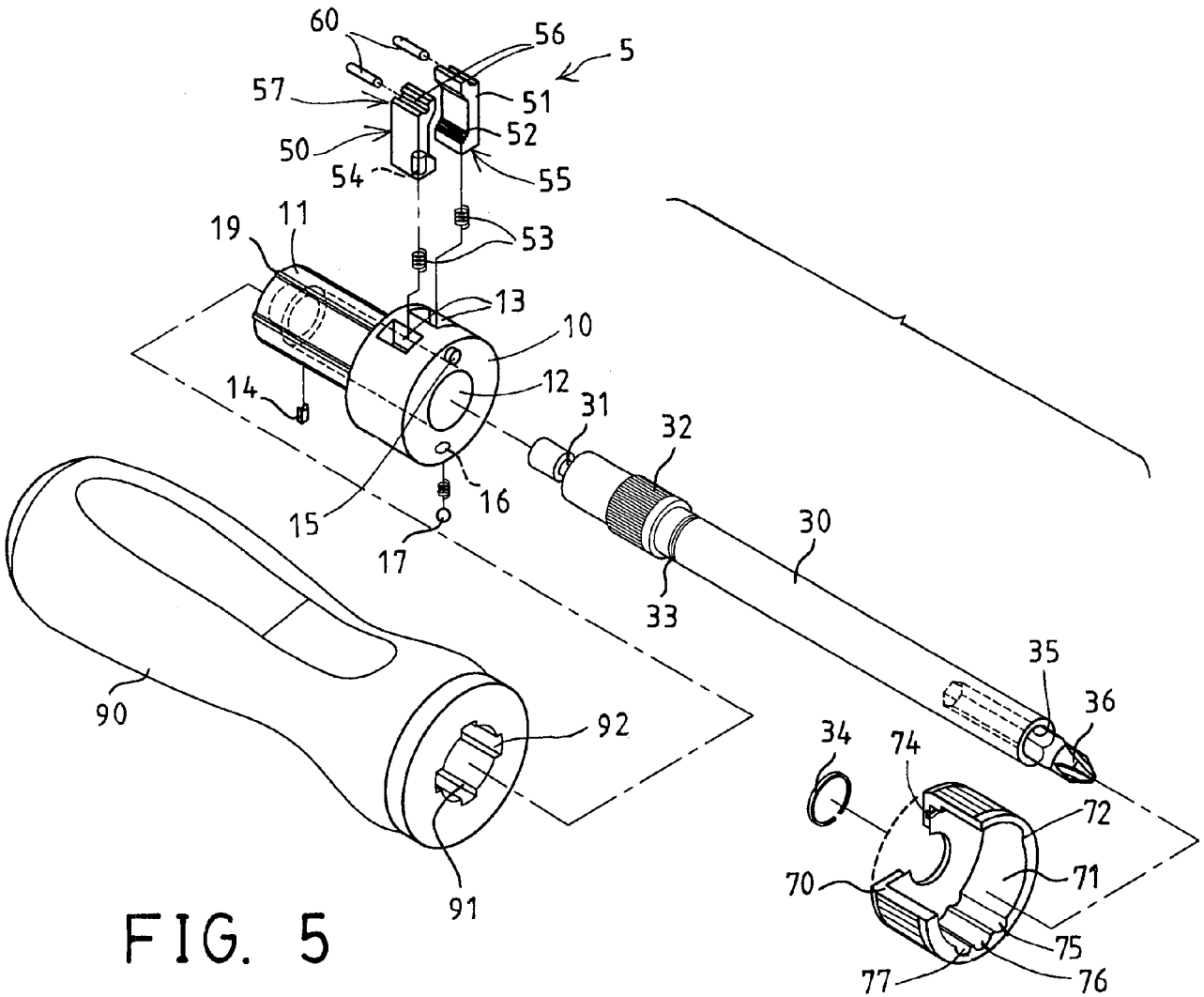
FIG. 5 is an exploded view similar to FIG. 1, illustrating the other characteristics of the pawl engaging structure of the ratchet tool.

As shown in FIGS. 1 and 3–4, the pawls 50, 51 each includes a recess 56 formed in the other end 57 thereof, for receiving a rounded or smooth or rotary member 60 therein, and arranged for allowing the rounded or smooth or rotary member 60 to be engaged between the control ferrule 70 and the pawls 50, 51, and to be engaged with the inner peripheral surface 71 and the actuating surfaces 72, 73 of the control ferrule 70, best shown in FIGS. 3 and 4. For example, the rotary or rounded or smooth member 60 may be a ball as shown in FIGS. 1 and 3–4, a roller as shown in FIG. 5, or other rotary or rounded or smooth pad member or the like, for smoothly engaging with the inner peripheral surface 71 and the actuating surfaces 72, 73 of the control ferrule 70.

In operation, as shown in FIGS. 3 and 4, when the control ferrule 70 is rotated relative to the cartridge 10 and the tool handle 90 and the tool member 30, only a point-contact or a line-contact or a reduced contact area may be formed between the rotary or rounded or smooth member 60 and the control ferrule 70, such that the control ferrule 70 may be easily and smoothly and swiftly rotated or moved relative to the rotary or rounded or smooth member 60, and such that the pawls 50, 51 may be easily and effectively moved relative to the cartridge 10 and the tool member 30, to effectively control the disengagement or engagement of the teeth 52 of the pawls 50, 51 with the corresponding teeth of the gear 32 of the tool member 30, without forming or generating a frictional force or without generating rubbing or wearing problems between the pawls 50, 51 and the control ferrule 70.

Accordingly, the ratchet tool in accordance with the present invention includes a rounded or smooth pawl engaging mechanism for allowing the pawls to be smoothly actuated to engage with the gear or the driving shank by the control ferrule, without forming or generating a frictional force or without generating rubbing or wearing problems between the pawls and the control ferrule.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a cartridge for attaching to a tool handle, including a chamber formed therein, and including two channels formed therein and communicating with said chamber thereof, a tool member rotatably engaged into said chamber of said cartridge, and including a gear provided thereon, two pawls slidably received in said channels of said cartridge respectively, and each including at least one tooth formed therein, and each including a recess formed therein, means for biasing said at least one tooth of said pawls to selectively engage with said gear of said tool member, and a control ferrule rotatably attached onto said cartridge, for engaging with said pawls, and for controlling an engagement of said pawls with said gear of said tool member, wherein said pawls each includes a rotary member provided thereon and rotatably engaged in said recess of said pawls and engaged between said control ferrule and said pawls, for forming a reduced contact area between said control ferrule and said rotary member, and for allowing said pawls to be effectively moved relative to said cartridge and said tool member and to be disengaged from or to be engaged with said gear of said tool member by said control ferrule.

2. The ratchet tool as claimed in claim 1, wherein said rotary member is a ball.

3. The ratchet tool as claimed in claim 1, wherein said rotary member is a roller.

4. The ratchet tool as claimed in claim 1, wherein said control ferrule includes an inner peripheral surface and two actuating surfaces formed therein, for engaging with said pawls respectively.

5. The ratchet tool as claimed in claim 1, wherein said control ferrule includes three depressions formed therein, and said cartridge includes a spring-biased projection engaged therein, for engaging with either of said depressions of said control ferrule, and for positioning said control ferrule to said cartridge at selected angular positions.

6. The ratchet tool as claimed in claim 1, wherein said control ferrule includes a slot formed therein, and said cartridge includes a protrusion extended therefrom, for engaging with said slot of said control ferrule, and for limiting said control ferrule to rotate relative to said cartridge.

7. The ratchet tool as claimed in claim 1, wherein said tool member includes an annular groove formed therein, and a positioning pin engaged into said cartridge, and engaged into said annular groove of said tool member, for rotatably anchoring and securing said tool member to said cartridge.

8. The ratchet tool as claimed in claim 1, wherein said tool member includes a retaining ring attached thereto and engaged with said control ferrule, for rotatably securing said control ferrule to said tool member and to said cartridge.

* * * * *